United States Patent [19]

DuPree

[11] 3,954,568

[45] May 4, 1976

[54] ELECTROFORMING AN ENDLESS FLEXIBLE SEAMLESS XEROGRAPHIC BELT

[75] Inventor: Donald G. DuPree, Alta Loma, Calif.

[73] Assignee: Xerox Corporation, Stamford, Conn.

[22] Filed: Aug. 8, 1974

[21] Appl. No.: 495,612

Related U.S. Application Data

[63] Continuation-in-part of Ser. No. 7,289, Jan. 30, 1970, abandoned.

[52] U.S. Cl. ..... 204/9

[51] Int. Cl.[2] ..... C25D 1/02

[58] Field of Search ..... 204/9, 3

[56] References Cited

UNITED STATES PATENTS

| | | | |
|---|---|---|---|
| 1,555,840 | 10/1925 | Hanley | 204/12 X |
| 1,709,268 | 4/1929 | Hutchins | 204/9 |
| 2,287,122 | 6/1942 | Norris | 204/9 X |
| 3,476,657 | 11/1969 | Lundquist | 204/9 X |

FOREIGN PATENTS OR APPLICATIONS

| | | | |
|---|---|---|---|
| 4,499 | 4/1885 | United Kingdom | 204/9 |
| 8,108 | 3/1893 | United Kingdom | 204/9 |

*Primary Examiner*—G. L. Kaplan

*Attorney, Agent, or Firm*—James J. Ralabate; James P. O'Sullivan; Donald M. MacKay

[57] ABSTRACT

A method of forming a xerographic belt substrate is provided in which the conductive metal backing is an endless flexible seamless band of nickel. The substrate band is made by electroforming, using a cylindrical mandrel of aluminum with a thin coating of stainless steel, passivated nickel or chromium and an electroplating nickel solution. During the electroforming operation the mandrel is rotated about an anode disposed in the electroplating solution.

7 Claims, 2 Drawing Figures

ELECTROFORMING AN ENDLESS FLEXIBLE SEAMLESS XEROGRAPHIC BELT

This application is a continuation in part of U.S. Ser. No. 7,289 filed Jan. 30, 1970, now abandoned.

BACKGROUND OF THE INVENTION

In the usual practice of xerography, an electrostatic latent image of an object is formed on a recording medium called a xerographic plate. The xerographic plate may comprise a very thin layer of photoconductive insulating material such as selenium on a conductive metal backing such as brass. In a recent development, the conductive metal backing portion of the xerographic plate is shaped in the form of an endless flexible band or belt. Xerographic belt substrates have been made by joining together the ends of a strip of brass such as by welding, but the seam produced where the two ends of the strip are joined is an undesirable feature in that it reduces the overall lifetime of the belt and necessitates indexing the printing cycle of the machine or system in which the xerographic belt is used so that the electrostatic latent image will not be formed on the belt where the seam is located.

A preferred method of making belts is to electroform a metal on a mandrel in an electrolytic bath. A primary problem however, has been to obtain a mandrel upon which a metal coating such as nickel could be formed, yet easily removed without damaging the mandrel. Although it has previously been suggested that materials can be easily separated from each other when they have sufficiently different coefficients of expansion, it has been found that many other factors must be considered and that a method for easily removing electroformed nickel belts from a mandrel was not available. For example, although the coefficients of thermal expansion for nickel and aluminum are sufficiently different to suggest that the nickel could be easily removed if deposited directly on the aluminum (the coefficient of thermal expansion for aluminum is 23.4 times $10^{-6}$ inches per inch per degrees C, and 13.3 times $10^{-6}$ inches per inch per degrees C for wrought nickel), it would not be practical to plate nickel directly on the aluminum mandrel because the aluminum would dissolve in the bath and secondly, nickel is not easily separated from aluminum without abrading the aluminum. Consequently, it has not been a simple matter to deposit a removable metal on a mandrel of another metal since, as noted in Hutchins U.S. Pat. No. 1,709,268, there must be a surface upon which a good birth of deposit can be made, the metal to be coated must be insoluble or practically insoluble in the electrolyte and the attachment must not be so good that it cannot later be removed. (Column 1, lines 25–43) A forth requisite not mentioned by Hutchins is that the metal to be deposited must have a sufficiently different coefficient of expansion from the mandrel. It is these problems to which this invention is directed.

BRIEF DESCRIPTION OF THE INVENTION

It has now been discovered that the aforesaid defects can be obviated and a nickel belt formed and easily removed from a mandrel constructed of aluminum with a thin outer layer of chromium, passivated nickel or stainless steel. Because of its high coefficient of thermal expansion, the aluminum shrinks more rapidly than the nickel when the mandrel is cooled to permit easy and rapid removal thus said thin outer layer must not be so thick that it separates from the aluminum mandrel but must be thick enough so that the bath does not contact the aluminum mandrel. Further, because aluminum is easily machined, the mandrel is more easily and economically manufactured. Thirdly, aluminum has a high electrical conductivity making it ideally suited for electroplating. In addition, aluminum has a low heat capacity and high heat conductivity so it can be rapidly cooled and because it is light and easily transported, handling costs during the processing steps are reduced.

The chromium, or passivated nickel coating adheres to the aluminum and like the stainless steel it also protects it but does not resist removal of the nickel deposited thereon. Thus, whereas nickel is not easily separated from aluminum and further the aluminum would dissolve in the bath, the coating of stainless steel, passivated nickel or chromium obviates both difficulties to provide a mandrel and method of preparing belts of unexpected superiority.

DETAILED DESCRIPTION OF THE INVENTION

Figure 1:
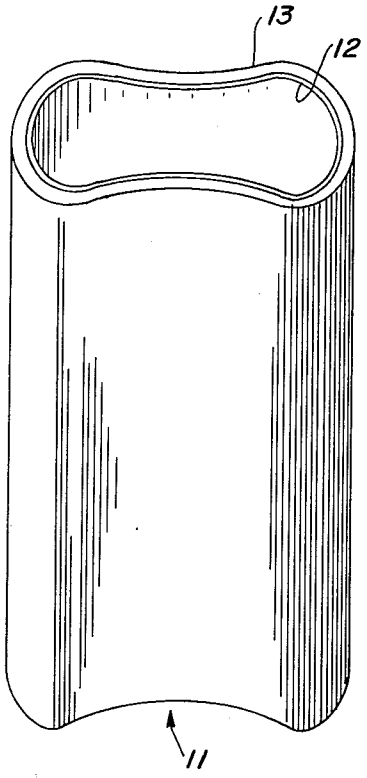
FIG. 1 is a perspective view of a xerographic belt constructed according to this invention.

Referring to the drawings, there is shown in FIG. 1 a xerographic belt 11 constructed according to this invention. The belt 11 includes an endless flexible seamless band 12 of nickel. The thickness of the nickel band is uniform and is around 0.003 to 0.010 inches. Formed on a surface of the band 12 is a layer 13 of photoconductive insulating material. The photoconductive insulating material may be, for example, selenium or selenium alloyed with small amounts of arsenic or tellurium or a pigment grade zinc oxide dispersed in an insulating film forming binder. The layer 13 is formed on the band 12 by any well known means. The band 12 is made by electroforming. The diameter and width of the belt 11 are both dependent on the particular xerographic machine or system in which the belt 11 is to be used. The diameter and width may both be as large as 10 inches or larger. The band 11 is uniform in thickness, has no discontinuities and has very little, if any, tensile stress.

Figure 2:
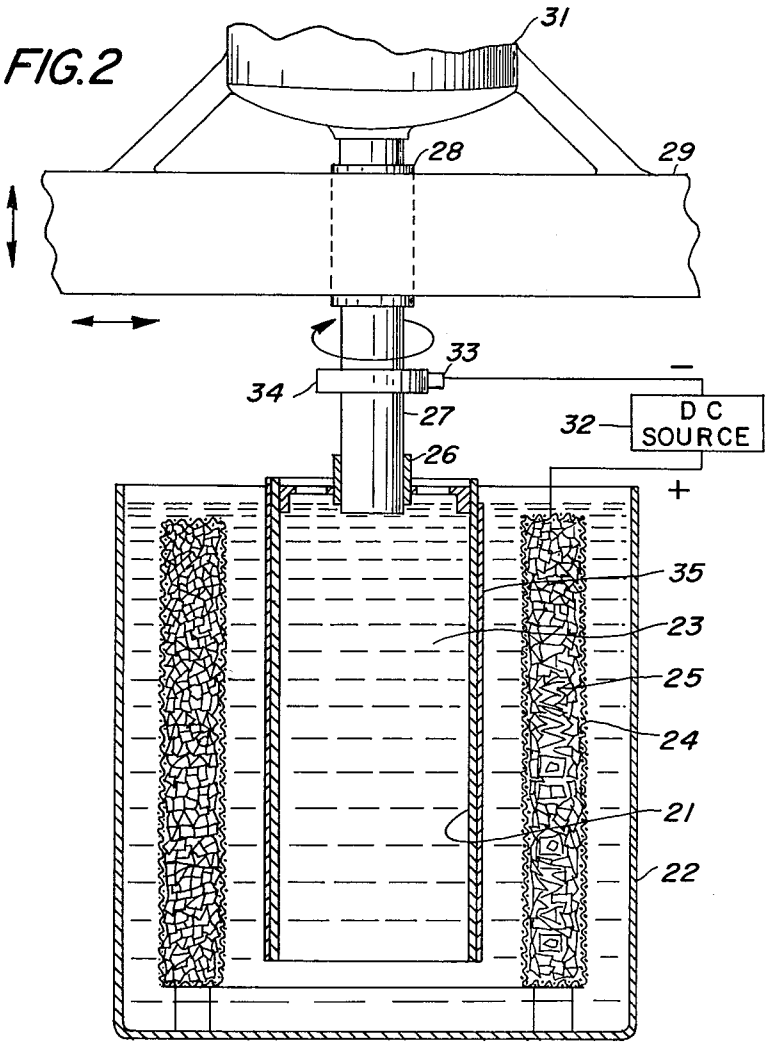
FIG. 2 is a schematic view in section showing an apparatus for electroforming an endless flexible seamless band of nickel.

A version of the apparatus for electroforming the nickel band 12 is illustrated in FIG. 2.

A cylindrically shaped mandrel 21 is suspended vertically in an electroplating tank 22. The mandrel 21 is made of aluminum with a thin coating of chromium or stainless steel. The inner surface and the top and bottom edges of the mandrel 21 are masked off with a suitable non-conductive material, such as wax (not shown). The mandrel 21 is circular in cross-section and may be hollow. The electroplating tank 22 is filled with a plating solution 23 of nickel sulfamate. The temperature of the plating solution is between around 100° and 160°F and preferably between 135° and 145°F. Disposed in the electroplating tank 22 and surrounding the mandrel 21 is an annular shaped anode basket 24 which is filled with nickel chips 25. The anode basket 24 is disposed so as to be in axial alignment with the mandrel 21. The nickel sulfamate solution may comprise the following ingredients in the following amounts: nickel sulfamate, about 40 ounces per gallon; nickel chloride, about 0 to 2 ounces per gallon; boric acid, about 4 to 6 ounces per gallon; a wetting agent such as an aqueous solution of sodium lauryl sulfate, about 0.02 avoirdupois ounces per gallon; nickel metal content, about 10 to 12 ounces per gallon; and a stress reducer such as sodium salt of saccharin, about 0 to 0.5 fluid ounces per gallon. The mandrel 21 is connected by a spider 26, which is made of conductive material, to a rotable drive shaft 27, which is also made of conductive material. The drive shaft 27 is supported by a bearing 28 on a frame member 29. The bearing 28 is made of insulative material so as to be insulated from the frame member 29. The frame member 29 is movable (by means not shown) horizontally and vertically so that the mandrel 21 can be brought into and moved out of the region of the electroplating tank 22 and lowered into and raised out of the electroplating tank 22. The drive shaft 27 is connected to a motor 31 which is also mounted on the frame member 29. The drive shaft 27 is electrically insulated from the motor 31 by an insulative coupling (not shown). Electroplating current is supplied to the electroplating tank 22 from a D.C. source 32. The current density supplied by the D.C. source 32 is about 20 to 300 amps per square foot, and preferably 150 amps per square foot. The positive end of the D.C. source 32 is connected to the anode basket 24. The negative end of the D.C. source 32 is connected to a brush 33 and slip ring 34 arrangement on the drive shaft 27. The electroplating current passes from the D.C. source to the anode basket 24, to the plating solution 23, to the mandrel 21 (which is the cathode), to the metal spider 26, to the drive shaft 27, to the brush 33 and slip ring 34 arrangement and back to the D.C. source 32. In operation, the mandrel 21 is lowered into the electroplating tank 22 and is continuously rotated about its vertical axis. As the mandrel 21 rotates, a layer of nickel 35 is deposited on its outer surface. The layer of nickel 35 is of uniform thickness since the distance between the mandrel 21 and the anode basket is the same at all times. When the layer of deposited nickel 35 has reached the desired thickness, the mandrel 21 is removed from the electroplating tank 22 and immersed in a cold water bath (not shown). The temperature of the cold water bath may be about 40°F. When the mandrel 21 is immersed in the cold water bath, it shrinks at a faster rate than the deposited nickel 35 due to its higher thermal properties of conductivity and expansion. The layer of deposited nickel 35 does not adhere to the mandrel because of the chromium or stainless steel coating. Consequently, as the shrinking process occurs the layer of deposited nickel 35, which is in the form of an endless flexible seamless band, is slipped off the mandrel 21. The mandrel 21 may be used again to form another nickel band.

Having described the invention with reference to specific embodiments it is to be understood that numerous variations can be made without departing from the spirit of the invention and it is intended to encompass such reasonable variations or equivalents within its scope.

What is claimed is:

1. A method of making an endless flexible seamless xerographic substrate belt which comprises forming a thin continuous layer of nickel of uniform thickness on the outer surface of a cylindrically shaped rotating mandrel by electrolytic deposition in a nickel containing bath, said mandrel constructed of aluminum having a thin outer layer of chromium, passivated nickel or alternatively of stainless steel and removing the resultant nickel belt from the mandrel by cooling said mandrel.

2. The method of claim 1 wherein the mandrel is untapered.

3. The method of claim 1 wherein the bath comprises nickel sulfamate.

4. The method of claim 1 wherein the nickel layer deposited is about 0.003 to 0.010 inches thick,

5. The method of claim 1 wherein the mandrel has an outer later of chromium.

6. The method of claim 1 wherein the mandrel has an outer layer of stainless steel.

7. The method of claim 1 wherein the mandrel has an outer layer of passivated nickel.

* * * * *